US005404811A

United States Patent [19]

Schiel et al.

[11] Patent Number: 5,404,811

[45] Date of Patent: Apr. 11, 1995

[54] ROLL PRESS FOR THE TREATMENT OF A TRAVELING WEB WITH CONNECTION BETWEEN THE PRESS UNITS

[75] Inventors: Christian Schiel, Heidenheim; Joachim Grabscheid, Heuchlingen, both of Germany

[73] Assignee: J. M. Voith GmbH, Heidenheim, Germany

[21] Appl. No.: 98,362

[22] PCT Filed: Dec. 10, 1992

[86] PCT No.: PCT/DE92/01029

§ 371 Date: Aug. 9, 1993

§ 102(e) Date: Aug. 9, 1993

[87] PCT Pub. No.: WO93/12289

PCT Pub. Date: Jun. 24, 1993

[30] Foreign Application Priority Data

Dec. 11, 1991 [DE] Germany ..... 41 40 879.9

[51] Int. Cl.[6] ..... D21G 1/00; B30B 3/04; D21F 3/02

[52] U.S. Cl. ..... 100/163 R; 100/153; 100/162 B; 100/168; 162/273; 162/360.3

[58] Field of Search ..... 100/153, 161–164, 100/168–171, 162 B; 72/232, 240, 237, 245, 246; 162/272, 273, 358.3, 360.2, 360.3

[56] References Cited

U.S. PATENT DOCUMENTS

| | | | |
|---|---|---|---|
| 1,073,611 | 9/1913 | Lindemann | 100/161 X |
| 2,720,910 | 10/1955 | Rockstrom et al. | 100/163 R X |
| 3,515,637 | 6/1970 | Reynolds et al. | 100/164 X |
| 3,983,811 | 10/1976 | Fuchs et al. | 100/162 B X |
| 4,272,317 | 6/1981 | Roerig | 162/358.3 X |
| 4,790,908 | 12/1988 | Roerig et al. | 162/199 |
| 4,877,487 | 10/1989 | Miller | 162/360.3 |
| 4,973,384 | 11/1990 | Crouse et al. | 162/358.3 X |
| 5,087,325 | 2/1992 | Page | 162/360.2 X |

FOREIGN PATENT DOCUMENTS

| | | | |
|---|---|---|---|
| 3117787 | 12/1982 | Germany . | |
| 4102356 | 1/1992 | Germany . | |
| 836596 | 6/1960 | United Kingdom . | |
| 1405919 | 6/1988 | U.S.S.R. | 72/246 |
| 92/17641 | 10/1992 | WIPO . | |

*Primary Examiner*—Stephen F. Gerrity
*Attorney, Agent, or Firm*—Ostrolenk, Faber, Gerb & Soffen

[57] ABSTRACT

Two press units have axes which lie in a pressing plane which is inclined to the vertical direction and they form a press nip with each other. The two press units are supported by bearing brackets which are coupled in pairs to each other by detachable tension bars which transmit the pressing force. The bearing brackets of the one press unit are supported rigidly (i.e. directly on a machine frame, foundation, or the like) and bear at least a part of the weight of the other press unit. A support device on the machine frame, foundation, or the like at least temporarily takes up a component of the weight of the other press unit which is directed transverse to the pressing plane.

25 Claims, 5 Drawing Sheets

E2
3
24
II
23
22
19
25
10
18
u
u
9
20
2
59
9
E1
I
14
1
21
11
16
60
V
8
17
15

42
23
40
43
3
II
24
22
25
10
2
13
12
26
I
8
11
16
V
27
17
15

ROLL PRESS FOR THE TREATMENT OF A TRAVELING WEB WITH CONNECTION BETWEEN THE PRESS UNITS

BACKGROUND OF THE INVENTION

The present invention relates to a roll press, preferably for the treatment of a traveling web, for instance a web of paper. The roll press comprises two press units, for example press rolls, the main axes of which lie in a pressing plane and form with each other a press nip through which the web travels. The roll press can also comprise three press units which form two press nips, or four press units which form three press nips.

The invention proceeds from a roll press having the following features. It is a roll press for the treatment of a traveling web of paper having two press units which may be in the form of press rolls. Each press unit, hereafter called a press roll, has a respective axis. The axes together lie in a press plane. The press rolls are so placed as to define a first press nip between them. One of the two press rolls includes a stationary support member that supports a traveling or circulating press element around the support member and that supports an internal pressing device for radially outwardly biasing the traveling or circulating press element toward the web and the other press roll. There are respective bearing brackets at each end of each of the press rolls. The bearing brackets at each end of the rolls are connected to each other by detachable tension bars which transmit the pressing force between the bearing brackets at the respective roll end. One set of the bearing brackets for one of the press rolls are rigidly supported on a machine frame or foundation and bear or support the weight of the other press roll. As prior art, reference is had to WO 92/17641 published after the priority date claimed.

Explanation of a few terms:

The "main axis" of a press unit can, for instance, be the axis of rotation of a press-roll jacket or the longitudinal axis of the stationary support member of, for instance, a shoe-press unit (in the latter case, the axis of rotation can be arranged eccentric to the main axis).

The "rotating press element" can be a metallic press-roll jacket which is rotatable around a stationary support member and is displaceable radially relative to it, or a press traveling or circulating belt or tubular traveling or circulating press jacket in the case of a shoe press unit.

The "internal pressing device" can be either a pressure chamber in the shape of a half ring or a row of radially movable support elements, or else an elongated radially movable press shoe.

The "one press unit", the bearing brackets of which are rigidly supported, is arranged on a frame, foundation or the like or is fastened (by means of its brackets) suspended from a (for instance, vertical or horizontal) support. The "other press unit" can be arranged above, to the side of, or below the rigidly supported press unit; its weight is borne by the bearing brackets of the rigidly supported press unit. The expression "rigidly supported" covers also the bipartite bearing-bracket construction with axial guide elements in accordance, for instance, with Federal Republic of Germany Utility Model 92 04 405.0.

One essential feature of the roll press from which the present invention proceeds is that the bearing brackets are coupled to each other in pairs by means of detachable tension bars. These tension bars are the sole element for transmitting the pressing force from bearing bracket to bearing bracket. Thus, the machine frames of the roll press need be dimensioned only for the weight of the press units themselves, and not for the transmission of the pressing force. It is also important that the tension bars are easily detachable; therefore, with zero pressing force, they are preferably pretensioned to at most a fraction of the maximum pressing force.

Furthermore, these tension bars are in a certain sense movable or flexible so that the bearing brackets of the "other press unit" are movable parallel to the pressing plane relative to the bearing brackets of the rigidly supported press unit. This is in contradiction to the manner of construction in accordance with U.S. Pat. No. 3,921,514. In that case, instead of easily detachable tension bars, bolted connections are provided which clamp the bearing brackets together. Thus, these bolted connections must be strongly prestressed already in the unloaded condition of the roll press. Such bolted connections are extremely bulky and expensive in highly loaded roll presses; mounting and loosening again can be effected only at enormous expense. In this connection, it must be borne in mind that such roll presses are preferably used in paper manufacturing machines the width of which may in the extreme case be up to 10 m. In particular, many roll presses are developed as shoe presses in which the linear force prevailing in the press nip may reach an order of magnitude of 1000 kN/m. To complicate matters, in many cases an endless felt belt (serving for the removing of water from the web of paper) must pass through the press nip and such felt belt must be replaced at certain intervals of time by a new felt belt. Similarly, in the case of shoe presses the traveling or circulating flexible (for instance, tubular) press element must replaced from time to time. Due to the use of the said easily detachable tension bars, this work can be carried out within a relatively short time, so that the roll press rapidly ready to operate again.

According to WO '641, the pressing plane is i.e. the two press units of such a roll press lie vertically one above the other. Thus—for the above-indicated change work—one of the two press units can easily be moved vertical direction a distance away from the other press unit by means of a lifting device (after the removal of the tension bars). The reassembling of the roll press is then just as simple, since the main axis of the press unit to be removed always remains in the pressing plane during these operations.

Difficulties are present, however, in the assembling of the roll press and said change work when it is necessary that the pressing plane not be arranged vertically and if, therefore, the pressing plane is to form an angle of, for instance, between 20° and 90° with the vertical direction. Such an arrangement with shoe-press units is known from DE 31 17 787 A1; however, no structural details are disclosed therein.

SUMMARY OF THE INVENTION

The object of the present invention is therefore to improve the roll press described in WO '641 in such a manner that it can be easily assembled even if the pressing plane is not vertical and that said change operations are carried out as simply as possible.

This object is achieved in accordance with the invention, in principle, in the manner that a support device intended for the (at least temporary) reception of a component of the weight of the "other press unit" directed transverse to the pressing plane is provided on the machine frame foundation or the like. In other words, at a certain distance from that region of the machine frame (foundation or the like) on which the bearing brackets of the rigidly supported press unit are fastened, an at least temporarily active support device for the other press unit is provided on the machine frame. This support device must be developed rather differently in detail depending on the size of the angle between the pressing plane and the vertical direction. In numerous embodiments of the invention, therefore, it is seen to it that the support device serves at the same time for the guiding of the other press unit in the direction parallel to the pressing plane, so that the main axis of the other press unit always remains in the pressing plane. This is realized, for instance, in the manner that a stationary part of the support device has a guide surface which is at least approximately parallel to the pressing plane.

In other embodiments of the invention, the support device is developed as a pure force generator which produces a support force which counteracts the weight of the other press unit.

In again numerous embodiments of the invention, it is advantageous to take additional measures for the guiding of the other press unit parallel to the pressing plane, which measures are described in the parallel patent application Ser. No. 08/098,364 (pending) (Priority DE P 41 40 876.4). In accordance therewith, at each end of the roll press the bearing bracket of the other press unit is guided as directly as possible on the rigidly supported bearing bracket. This is effected, for example, by means of a removable guide piece which is arranged in central position between the bearing brackets. Finally, in accordance with said parallel patent application, tension bars can be pretensioned slightly even with a zero pressing force, this, for instance, by means of a spreading device or under the action of the weight of the other press unit. If the pressing plane is arranged vertically or forms merely a small angle with the vertical direction, the tension bars and the central guide surface act together in such a manner that the main axis of the other press unit, both with a pressing force of zero and also under full load, always remains with sufficient precision in the pressing plane. In this case, the support device of the invention (provided to receive a component of the weight of the other press unit directed transverse to the pressing plane) is not required during the normal operation of the roll press. In this case, namely, said transverse component is relatively small so that it can be transmitted via the tension bars to the bearing bracket of the rigidly supported press unit.

In other words, the support device of the invention is required in said case only during the mounting of the roll press or during the work for replacing a felt or a roll jacket since, for this, the tension bars must be removed and the central guide surface is temporarily inactive. In this case, therefore, the support device of the invention is required for the temporary moving apart of the two press units. This is effected in the manner that again the main axis of the other press unit remains completely (or at least approximately) in the pressing plane. Accordingly, after the two press units have again been brought together, the parts which have been removed can be easily installed again, within a short time.

Other embodiments of the invention make it possible for the pressing plane to form a relatively large angle with the vertical direction, up to the horizontal arrangement of the pressing plane. In this case, the component of the weight of the other press unit which is directed transverse to the pressing plane can be so great that it can no longer be transmitted by the tension bars to the bearing bracket of the rigidly supported press unit. In this case, the support device of the invention is active also during the normal operation of the roll press in order to transmit the transverse component directly to the machine frame, foundation or the like. In this case, also, the support device of the invention can either be developed as a pure generator of supporting force or else the support device is so developed that it also serves for guiding the other press unit parallel to the pressing plane, since the possibility of movement of the bearing brackets of the other press unit parallel to the pressing plane is, of course, to be retained.

In one particularly simple embodiment of the invention, the bearing brackets of the other press unit rest directly on guide surfaces which are parallel to the pressing plane.

On the basis of the invention, it is now possible to arrange roll presses of the aforementioned type (in accordance with WO '641) with any desired inclination to the vertical. In particular, it is now possible to use the said roll-press construction in compact arrangements of three or four press units, in accordance, for instance, with the aforementioned DE 31 17 787 A1. In this connection, preferably, the rigidly supported press unit is developed as central roll. The roll jacket of this central roll as a rule comes into direct contact with the web which travels, in succession, through the two (or three) press nips. Again, different variants are now again possible: In a first variant, only one of the press nips (either the first or the second) is formed by a shoe-press unit which cooperates with the central roll (the other is formed by, for instance, a traditional suction press roll or grooved press roll). In this case, only the bearing brackets of the said shoe-press unit are coupled by the aforementioned detachable tension bars to the bearing brackets of the central roll. In another variant, two shoe-press units are provided on the circumference of the central roll. In this case, each of the bearing brackets of the central roll—in accordance with a further aspect of the invention—has two arms for the connecting of the detachable tension bars for each of the two shoe-press units. In other words, each of the bearing brackets of the central roll has four arms distributed on its circumference for the connecting of the tension bars.

Possibilities for the use of the roll press of the invention in the press end of a paper manufacturing machine and further details of the invention will be explained below with reference to the drawings.

DESCRIPTION OF PREFERRED EMBODIMENTS

Figure 1:
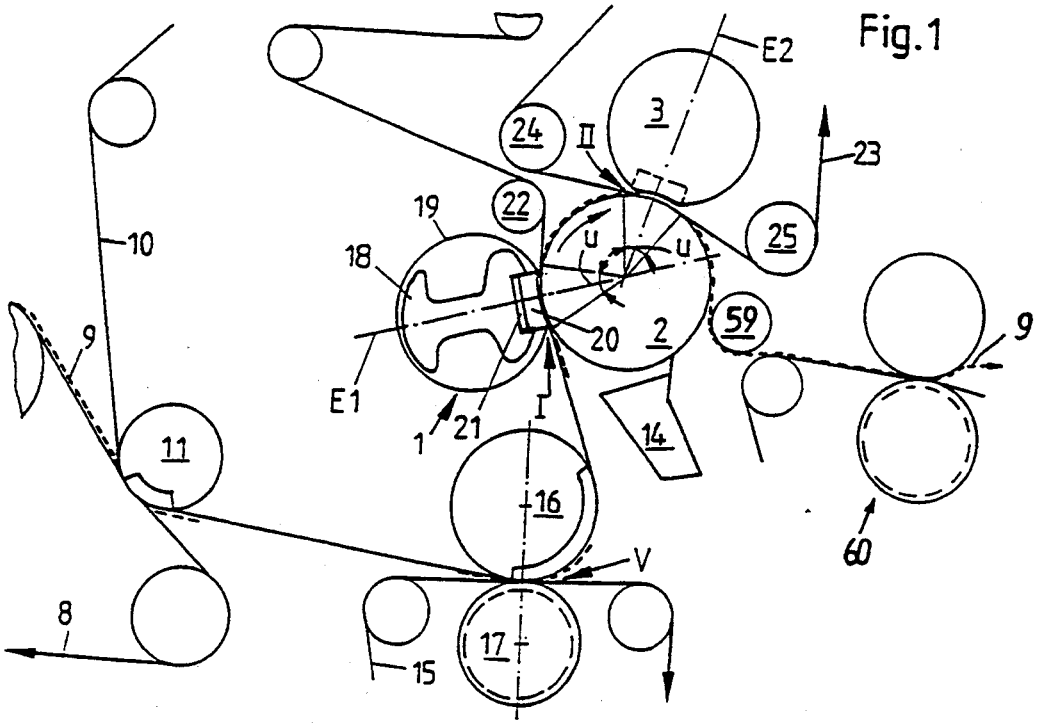
FIG. 1 diagrammatically shows the rolls of a press end.

FIG. 1 shows a so-called divided three-nip press section of a paper manufacturing machine. The main part is a central roll 2. It corresponds to a rigidly supported press unit. It has a smooth roll jacket which contacts the one side of the web of paper 9 from which the water is to be removed. It forms a first press nip I and a second press nip II with two press units 1 and 3. The paper web 9 is formed in customary manner in a wire section. A part of the wire belt 8 can be noted in FIG. 1. The web is removed from it by a support belt (for instance, take-up felt 10) and by a take-up suction roll 11, conducted through a pre-press-nip V and then fed, from below, to the first press nip I. The receiving felt 10 then separates from the web 9. The web travels with the smooth jacket surface of the central roll 2 through the second press nip II and then a distance downward until it is transferred by means of a press guide roll into a following additional roll press 60 (which can also be omitted). Here, the other side of the web comes into contact with a smooth roll jacket. During the starting of the paper machine, the web is removed from the central roll 2 in customary manner by means of a scraper 14 and conducted downward into a reject collection container.

The pre-press nip V through which the web 9 passes between the take-up felt 10 and a bottom felt 15 is formed by an upper suction press roll 16 and a lower press roll 17. The suction press roll 16 serves at the same time as a guide roll.

The two press units 1 and 3 are developed as shoe-press units. As is diagrammatically shown in the case of the shoe-press unit 1, each shoe-press unit has a stationary support member 18 and a flexible revolving liquid-tight press element 19. The latter is preferably developed as a tubular press jacket which is closed at its two ends. The press element 19 is pressed with a selectable pressing force against the central roll 2 by means of a press shoe 20 which has a concave slide surface. The press nips I and II are therefore areal or "lengthened" press nips. The press shoe 20 rests in a recess 21 developed as pressure chamber in the support member 18. The pressure prevailing therein is ordinarily adjustable between zero and a maximum.

The central planes of the shoe-press units 1 and 3 are the so-called pressing planes E1 and E2. The take-up felt 10 must wrap around a relatively large sector u of the circumference of the central roll (on both sides of the pressing plane E1). In this way, the position of the suction press roll 16 and of the felt guide roll 22 (following the first press nip I) is determined. The same applies to the top felt 23 which travels through the second press nip II, and to the corresponding felt guide rolls 24 and 25. From this, there results the following advantageous arrangement of the press nips: The first press nip I lies preferably in the 8:00 o'clock position with respect to the central roll 2, while the second press nip II is arranged preferably in the 1:00 o'clock position. It should be noted, however, that other arrangements are also possible; for example, the press plane E2 can be vertical.

Figure 2:
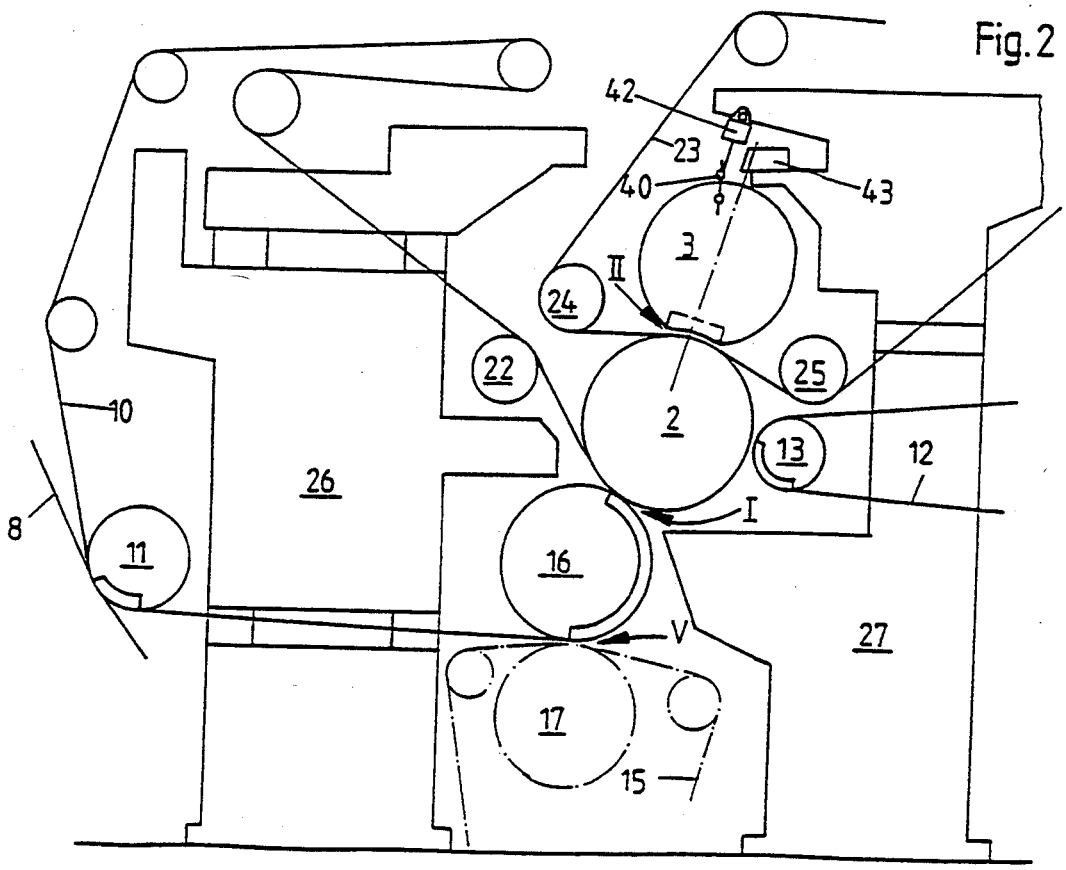
FIG. 2 diagrammatically shows a press end which differs from FIG. 1 and the corresponding machine frame.

Differing from FIG. 1, in FIG. 2 only the second press nip II is formed by a shoe-press unit 3. For the forming of the first press nip I, the suction press roll 16 lies directly against the central roll 2. In the same way as in FIG. 1, the bottom felt 15 and the bottom press roll 17 (for the formation of the pre-press nip V) can be provided or omitted, depending on the nature of the web of paper to be produced. A multipart machine frame 26 which bears the rolls of the take-up felt 10 is diagrammatically indicated, as well as another machine frame 27, also consisting of several parts; it bears the central roll 2, the shoe-press unit 3, the scraper 14, which is not shown (in FIG. 2), and the guide rolls of the top felt 23 as well as a take-up roll 13 over which a drier wire 12 of a following drying section (not shown) travels.

Figures 3, 3A:
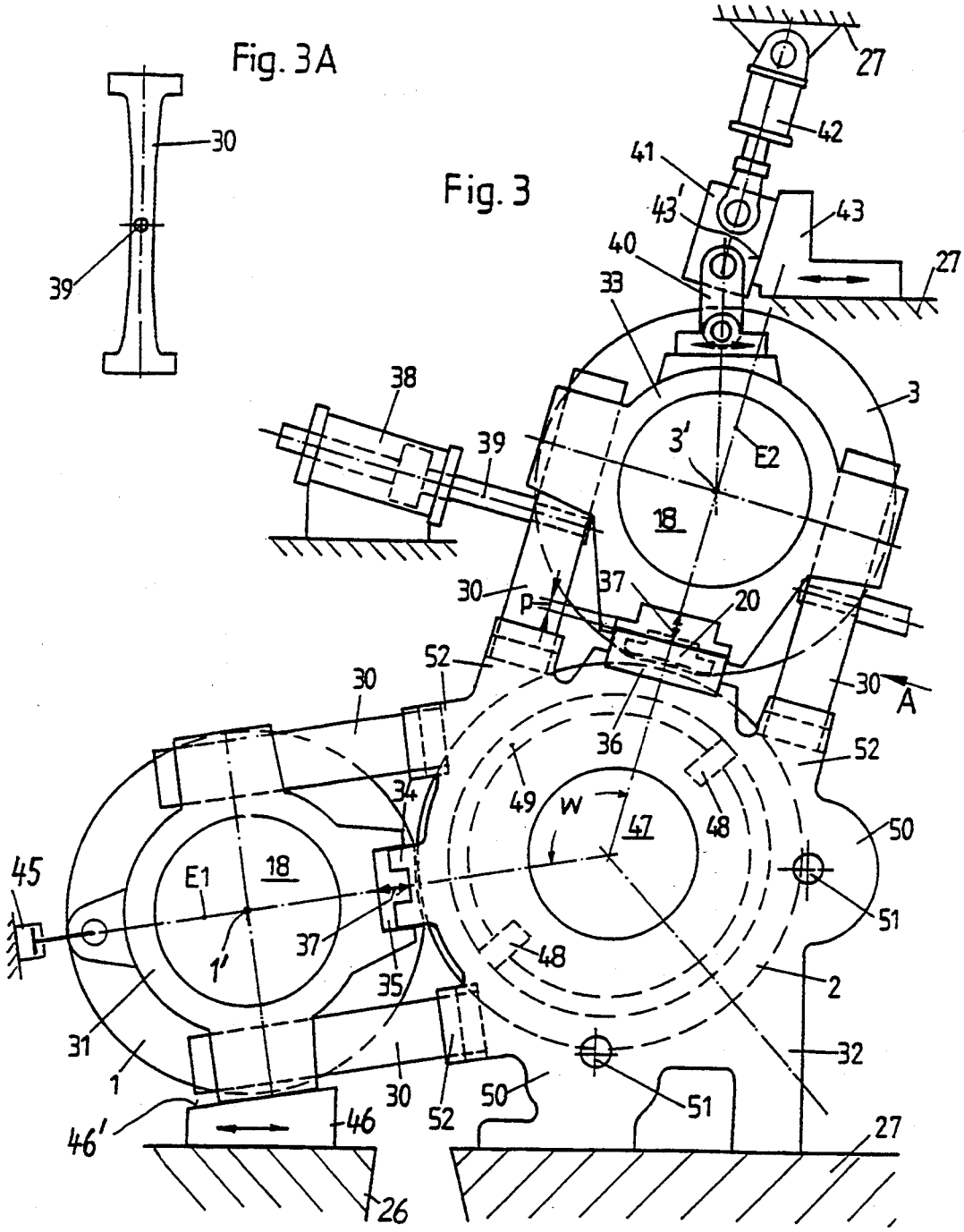
FIG. 3 shows an enlarged detail of FIG. 1.
FIG. 3A shows a tension bar (seen in the direction of the arrow A of FIG. 3).

FIG. 3 shows details of the roll press of FIG. 1 which consists of three press units. Again, there can be noted the central roll 2 and the two shoe-press units 1 and 3, and furthermore a bearing bracket 32 of the central roll 2 which is rigidly fastened to the machine frame 27 and one bearing bracket 31, 33 each, in which the stationary support members 18 of the shoe-press units 1, 3 rest. For example, the bearing bracket 33 is connected to the bearing bracket 32 of the central roll 2 by means of detachable tension bars 30, also known as "tie rods". They serve in operation for alone transmitting the pressing force from the one bearing bracket to the other. The tie rods 30 are, for instance, of I-shape (shown in FIG. 3A). However, numerous other constructions can also be used; for example, the so-called divisible tension spindle enters into consideration (in accordance with the non-prior-published German OS-P 41 33 500.7. Other possible constructions are, for example, straps with bolts. It is merely essential that the tie rods be easily detachable since it must be able to remove them readily (in whole or in part) for the replacement of a felt belt or of a press jacket. The arrangement is therefore such that in the case of zero pressing force, the tie rods are pretensioned to at most a fraction of the maximum pressing force and that two adjacent bearing brackets are not rigidly clamped to each other (for instance, by means of bolts). Rather, the bearing brackets 31, 33 are movable relative to the bearing bracket 32 in the direction of the pressing plane.

In accordance with FIG. 3, the pressing planes E1 and E2 are arranged obliquely as in FIG. 1 in such a manner that the first press nip is approximately in the 8:00 o'clock position and the second press nip in approximately the 1:00 o'clock position. From this configuration there results the further advantage that the angle W between the two pressing planes is between 100° and 130°, so that arms 52 which are necessary for connecting the tie rods 30 can be arranged on the circumference of the bearing bracket 32 of the central roll 2 for both shoe-press units 1 and 3. This would not be possible if the said angle W were smaller.

In order that the main axes 1' and 3' of the shoe-press units 1 and 3 always remain in the pressing planes E1, E2, adjacent bearing brackets 31, 32 and 32, 33, respectively, are "centered" with respect to each other. Stated more precisely, each movable bearing bracket 31, 33 is guided parallel to the pressing plane on a guide surface of the rigidly supported bearing bracket 32. For this purpose, the bearing bracket 32 has, for instance, a projection 34 the side surfaces of which fit in form-locked manner into a recess 35 in the bearing bracket 31. Projection 34 and recess 35 thus form two pairs of guide surfaces which lie parallel to the pressing plane E1. For the preparation for the change of a felt or press jacket, it is necessary that, after the removal of the tie rods 30, the shoe-press unit 1 must be moved sufficiently far from the central roll 2 that the projection 34 and recess 35 come out of engagement.

Another possibility is provided between the bearing brackets 32 and 33: In that case, a block-shaped removable intermediate piece 36 engages by its side surfaces in form-locked manner into, in each case, a recess in the bearing brackets 32 and 33. The intermediate piece 36 thus serves, at the same time, as guide piece. For the pretensioning of the tie rods 30, there are provided tensioning devices 37, represented symbolically by double-ended arrows, present, for instance, in the recess 35 between the bearing brackets 31 and 32 or between the intermediate piece 36 which rests on the bearing bracket 32 and the bearing bracket 33. With regard to the details, reference is had to the parallel patent application Ser. No. 08/098,364 (Priority DE P 41 40 876.4). The pretensioning device can, however, also be arranged outside the recesses 35, for instance on the tie rods 30.

FIG. 3 shows only the one end of the roll press. It is obvious that identical or at least similar bearing brackets 31–33, tension bars 30 and the other elements are present on the other end.

The removing and installing of the tie rods 30 is effected by means, for instance, of a pneumatic cylinder 38 which is supported, with only slight yieldability, in the machine frame (not shown). Its piston rod 39 is so dimensioned and supported that it can bear the weight of a tie rod 30. For this purpose, the pretensioning device 37 is made inactive; the bearing bracket 33 (with the complete press unit) is let down by the distance p by means of the lifting device 42 so that it rests on the intermediate piece 36. After the removal of the tie rods 30, the bearing bracket 33 (with the complete press unit) is again lifted in order to be able to remove the intermediate piece 36. This lifting is effected to such an extent that a certain distance which is necessary for the replacement of the felt or of the press jacket is produced between the roll jackets of the press units 2 and 3.

For example, the bearing bracket of the shoe-press unit 3 is coupled via a strap 40 and a slide block 41 to the lifting device 42. The slide block 41 can slide on a guide surface 43' of a support device 43 which is parallel to the pressing plane E2. Its position in the machine frame 27 is adjustable, for instance, in horizontal direction, as is the point of attack of the strap 40 on the bearing bracket 33. In this way, the result can be obtained that a raising or lowering of the shoe-press unit 3 is effected in such a manner that its central axis always remains in the pressing plane E2.

During normal operation of the roll press, the lifting device 42 is inactive so that the entire weight of the press unit 3 rests on the bearing brackets 32 of the central roll 2. This is possible because the angle between the pressing plane E2 and the vertical direction is relatively small. When the lifting device 42 is activated (for the replacement of the felt or of the press jacket) in order to lift the press unit 3, the support device 43 transmits to the machine frame 27 a component of the weight which is directed transverse to the pressing plane E2.

The pressing plane E1 is arranged practically horizontal. With this arrangement, it may happen that the weight of the shoe-press unit 1 is so great that it no longer can be transmitted to the bearing bracket 32 via the tension bars 30. In this case, the press unit 1 rests (at each end) on a support device 46 (again adjustable) which is also provided on the machine frame 26. For the sliding back or forth of the press unit a lifting device 45 is again present. The support device 46 again has a guide surface 46' which is parallel to the pressing plane E1 so that the main axis 1' of the press unit 1 always remains in the pressing plane E1. The centrally arranged guide elements 34, 35 can therefore be dispensed with in some cases, as can the spreading device 37, if their function can be exercised by the lifting device 45.

For the replacement of a press jacket of one of the shoe-press units 1 or 3, the one end of the press unit is lifted by means of known press-jacket introduction device (not shown) so that the support device 46 or the strap 40 can be removed.

In FIG. 3 it is furthermore diagrammatically indicated that the central roll 2 is developed as sag-adjustment roll; it therefore has a stationary yoke 47. Within the roll there is a pressure chamber 49 developed in the form of a half ring and limited by longitudinal sealing strips 48, this chamber being arranged between the yoke 47 and the roll jacket. The position of the sealing ledges 48 is determined by the position of the pressing planes E1 and E2 and by the amount of the pressing forces. In final result, the direction of action of the pressure chamber 49 lies in the resultant of the pressing forces. There are also diagrammatically indicated two bulges 50 (present only on the drive side roll end) of the bearing bracket 32 to receive drive pins 41 which serve in known manner for the driving of the roll jacket. These bulges must be arranged in that region of the circumference of the bearing bracket 32 which is free of the arms 52 into which the tie rods 30 engage.

Figure 4:
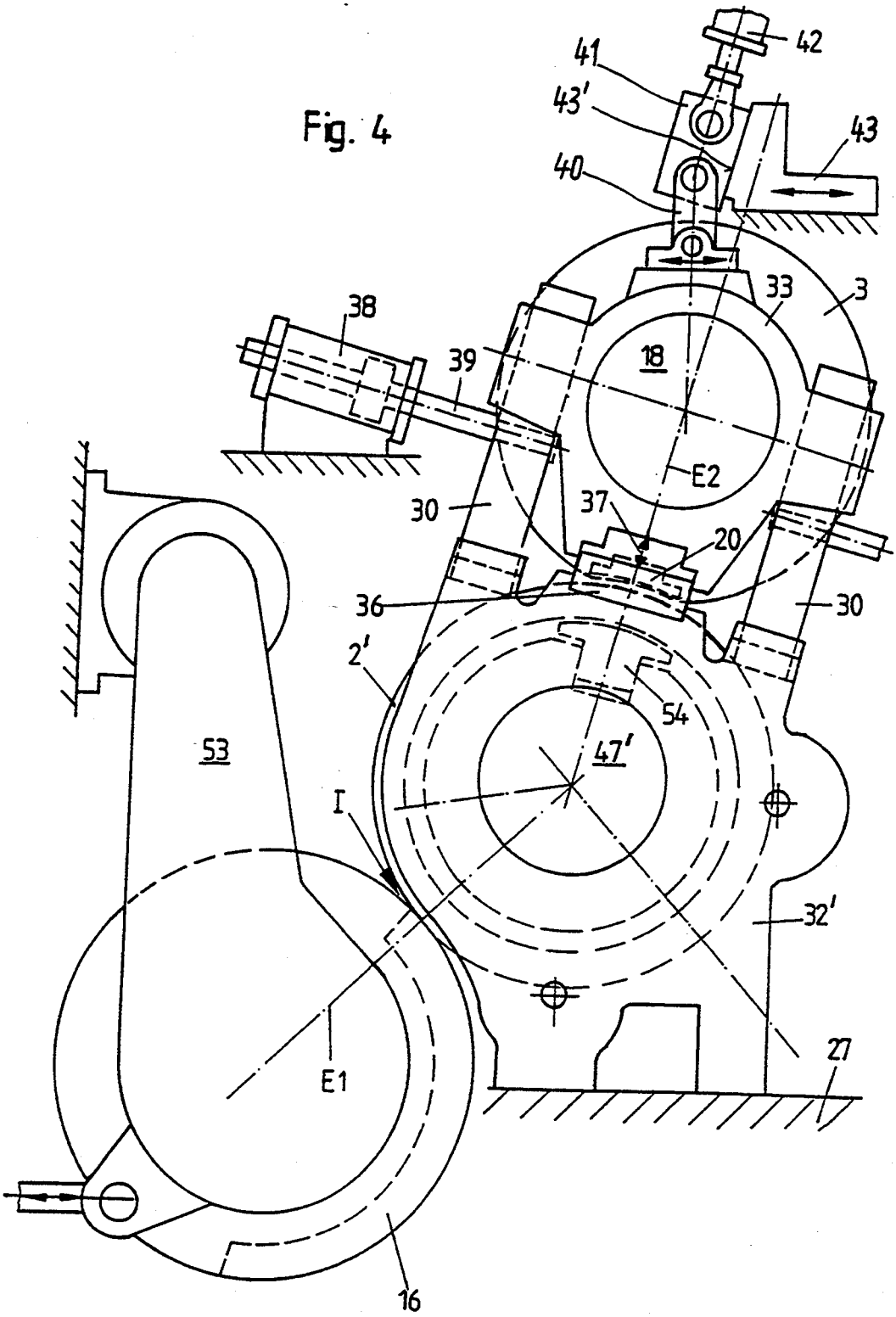
FIG. 4 shows an enlarged detail from FIG. 2.

Differing from FIG. 3, in FIG. 4 there is provided for the formation of the first press nip I, a suction press roll 16 which rests in traditional manner in swing levers 53 (which have suction channels). The central roll 2' is again developed as sag-adjustment roll, but now with a stationary yoke 47' and a slide shoe 54 (or with a corresponding row of individual slide shoes) which rests in known manner against the inner surface of the roll jacket and is movable relative to the yoke 47' parallel to the pressing plane E2. The shoe press unit 3 is developed in the same manner as in FIG. 3; in operation, it rests on the bearing brackets 32' of the central roll 2'.

Figure 5:
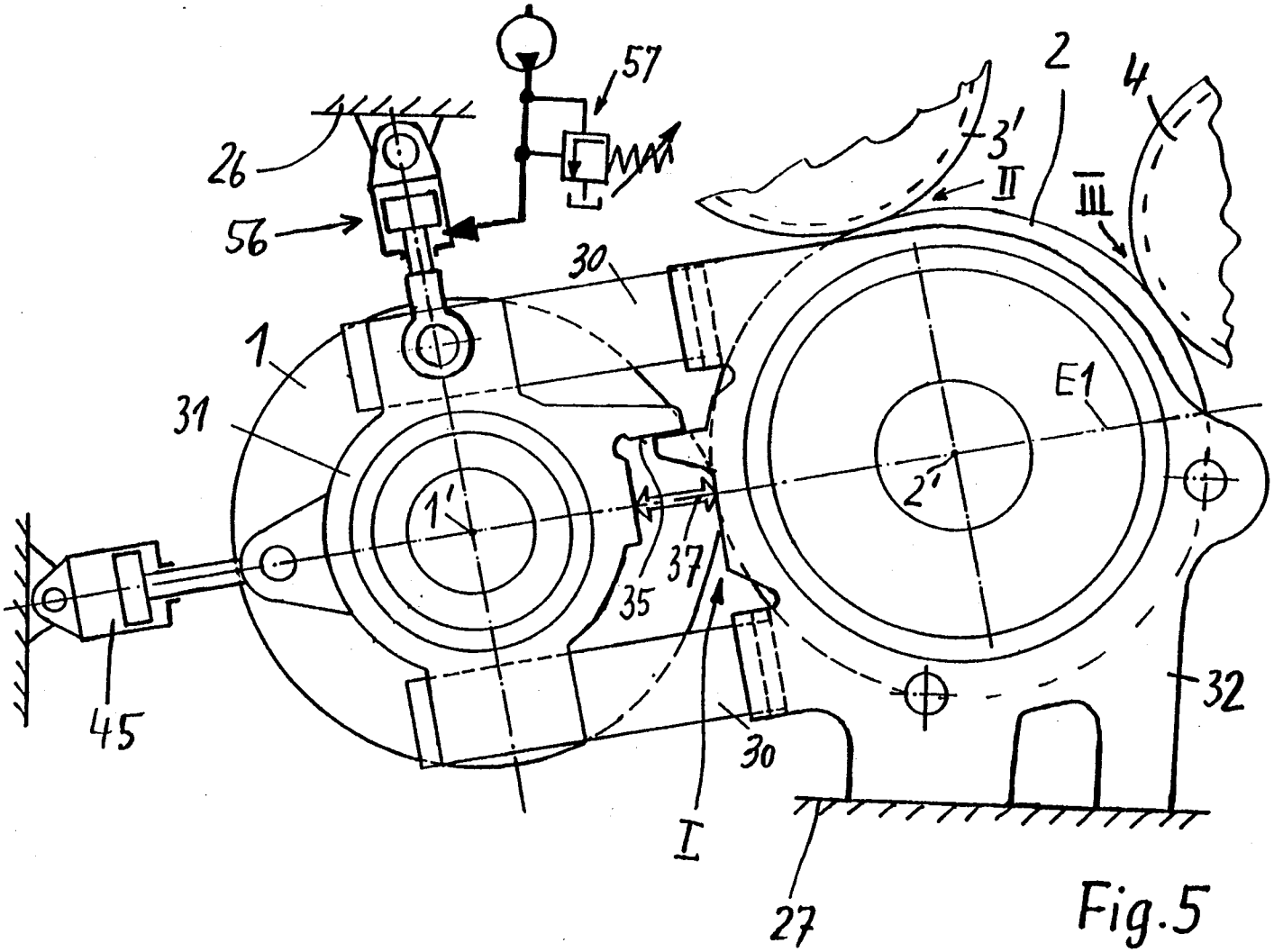
FIGS. 5 and 6 are diagrammatic showings of further embodiments of the invention.

In accordance with FIG. 5, the position of the pressing plane E1 is approximately the same as in FIG. 3. As support device for the shoe-press unit 1, a hydraulic cylinder 56 is provided, within the pressure space of which the hydraulic pressure is maintained at all times at a constant value (by means of a pressure control device 57). This value can be adjusted to the component of the weight of the press unit 1 directed transverse to the pressing plane E1. In accordance with FIG. 5, the support device 56 thus serves solely for transferring the said weight component to the machine frame 26, and not for guiding the press unit 1 parallel to the pressing plane E1. For this, a pair of central guide surfaces is provided (at 35) on the bearing brackets 31, 32. Differing from FIG. 5, the hydraulic cylinder 56 could also be arranged below the press unit 1.

Figure 6:
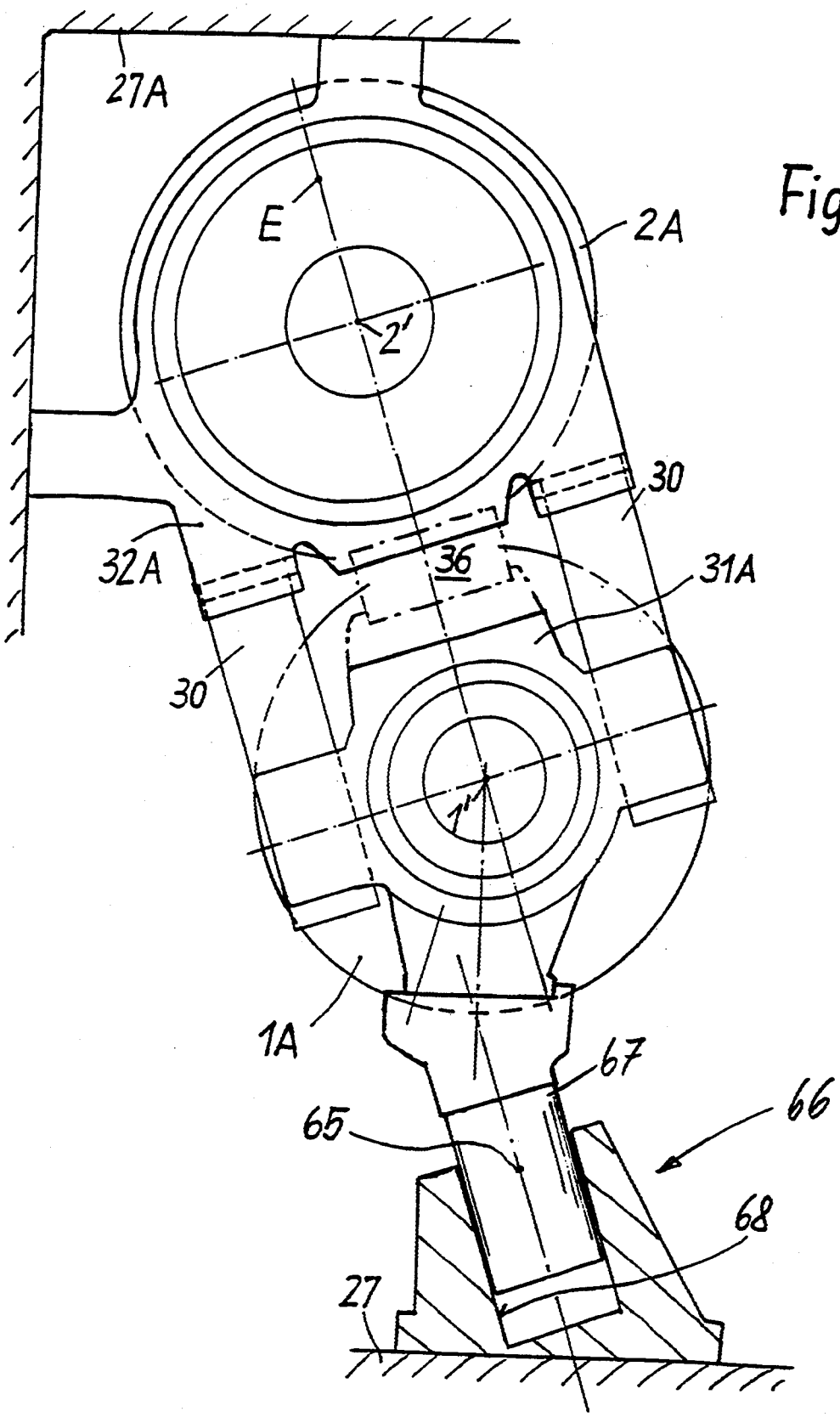

In FIG. 6, a press unit 1A is suspended by the tension bars 30 from the bottom of the bearing brackets 32A of a press unit 2A. The bearing brackets 32A are suspended from vertical and/or horizontal surfaces of a machine frame 27A. The pressing plane E is inclined to the vertical by only a small angle. Therefore, the support device 66 can be inactive during normal operation, i.e. the piston 67 of the single-acting hydraulic cylinder 68 can be drawn back in downward direction. Its axis 65 is parallel to the pressing plane E so that the cylinder 68 also serves as guide surface when it moves the bearing brackets 31A together with the press unit 1A (after removal of the tension bars 30) away from the press unit 2A.

In order to facilitate the correct positioning of the press unit 1A, a central removable guide piece 36 can again be provided between the bearing brackets 31A and 32A (as indicated in dash-dot line). The guide piece 36 can, however, also be omitted. In the latter case, a further modification is conceivable: A vertical-axis cylinder-piston unit is provided (instead of the support device 66 shown), it being adjustable by horizontal displacement on the foundation 27B.

We claim:

1. A roll press for the treatment of a traveling paper web, the roll press comprising:

a first press unit having a first axis and a second press unit having a second axis, the first and second axes lying in a pressing plane, the first and second press units being placed with respect to each other for defining a press nip through which the web travels;

the first press unit including a stationary support member, a traveling press element supported on and rotating around the support member for defining a jacket for cooperating in the press nip with the second press unit; an internal pressing device related to the support member moveable for causing such radial movement of the traveling press element as to create the press nip and to produce a pressing force that acts on the web in the press nip;

each of the first and second press units having opposite ends; respective first bearing brackets at the ends of the first press unit and respective second bearing brackets at the ends of the second press unit;

detachable tension bars at the ends of the press units including a respective tension bar coupling the first and second bearing bracket at each end of the press unit, the tension bars serving for transmitting pressing force between the bearing brackets;

a machine support; the first bearing brackets being rigidly supported by the machine support for supporting the first press unit and for supporting at least part of the weight of the second press unit;

the first and second press units being so placed that the pressing plane defined by the first and second axes defines an acute angle with respect to the horizontal;

a support device on the machine support for at least temporarily taking up a component of the weight of the second press unit, which weight component is directed transversely to the pressing plane.

2. The roll press of claim 1, further comprising guiding means on the support device additionally for guiding the second press unit in the direction parallel to the press plane.

3. The roll press of claim 2, wherein the guiding means comprises a stationary part of the support device extending at least approximately parallel to the pressing plane and with respect to which the second press unit is guided for motion.

4. The roll press of claim 3, wherein the respective bearing bracket for the second press unit is supported on the guide surface and moveable along the guide surface.

5. The press roll of claim 3, comprising a further structural part supported on and displaceable along the guide surface; means for coupling the structural part to the second bearing bracket of the second press unit;

a lifting device for lifting the second press unit and connectable with the structural part.

6. The roll press of claim 3, wherein the support device comprises a lifting device for the second bearing bracket having a direction of movement that is at least approximately parallel to the pressing plane.

7. The roll press of claim 6, wherein the lifting device comprises a device having an axis of movement that is at least approximately parallel to the pressing plane.

8. The roll press of claim 6, wherein the lifting device comprises a cylinder piston unit having an axis with a direction of movement that is at least approximately parallel to the pressing plane.

9. The roll press of claim 1, wherein the support device comprises a force generator which counteracts the weight of the second press unit, and the force generator is adapted for providing a support force that is adjustable to a value which remains constant.

10. The roll press of claim 9, wherein the force generator is pivotally connected to the bearing bracket of the second press unit.

11. The roll press of claim 9, wherein the force generator comprises a hydraulic cylinder-piston unit and a device connected to the pressure space of the hydraulic cylinder-piston unit for maintaining the hydraulic pressure therein constant.

12. The roll press of claim 1, wherein the second press unit comprises a shoe press, the press element thereof comprises a flexible tubular revolving press element around the shoe press and the internal pressing device comprises a shoe and means for urging the shoe radially outward against the press element.

13. The roll press of claim 12, wherein the support device is removable from the second bearing bracket of the second press unit, enabling changing of the press element.

14. The press roll of claim 1, further comprising means guiding the first and second bearing brackets of the press units relative to each other, parallel to the pressing plane.

15. The roll press of claim 14, further comprising a removable guide piece between at least one set of the first and the second bearing brackets; a recess defined in at least one of the bearing brackets, as seen in the axial direction, in which the guide piece is engaged, and the guide piece in the recess having side surfaces which are parallel to the pressing plane for guiding movement of the bearing brackets in the pressing plane.

16. The roll press of claim 15, further comprising a spreading device for acting on the first and second bearing brackets which are coupled to each other by the tension bars in order to pretension the tension bars.

17. The roll press of claim 1, wherein at the time of zero pressing force in the roll press, the tension bars are pretensioned to at most a fraction of the maximum pressing force that may be applied by the first and second press units against each other.

18. The roll press of claim 17, wherein the tension bars are so flexible that, at each end of the roll press, the first and second bearing brackets of each of the press units are movable in the pressing plane relative to each other.

19. The roll press of claim 18, wherein at least a part of each tension bar is removable in a direction transverse to the pressing plane.

20. The roll press of claim 18, further comprising a spreading device for acting on the first and second bearing brackets which are coupled to each other by the tension bars in order to pretension the tension bars.

21. The roll press of claim 1, wherein the rigidly supported first press unit is a central first press roll and forms a first press nip with the second press unit which also is a press roll, and the first and second press rolls come into direct contact with the web at the first press nip;

a third press roll in contact with the first press roll for defining a second press nip between them, the first press roll and the third press roll having respective axes which define a second pressing plane which is at an angle to the pressing plane defined by the respective axes of the first and second press rolls.

22. The roll press of claim 21, further comprising the third press roll having opposite ends, third bearing brackets at the opposite ends of the third press roll;

the first bearing brackets at each end of the first roll including means for receiving first tension bars between the first and second brackets and also means for receiving second tension bars between the first brackets and the third brackets and each of the second and third brackets including means for receiving the respective first and second tension bars therefor coupling each of the second and third brackets with the first brackets.

23. The roll press of claim 21, wherein the first, second and third press rolls are so placed that the axes of the press rolls define the two pressing planes to form an angle between them of about between 100°–150°.

24. The roll press of claim 21, wherein the first roll is a sag adjustment roll, including a stationary yoke, a press element in the form of a roll jacket around the yoke and a respective hydraulic support device which acts along each of the pressing planes to transmit support forces from the stationary yoke to each of the second and third press rolls along the first and second pressing planes.

25. The roll press of claim 24, wherein the first press roll includes a pressure chamber having the shape of an approximate half ring and disposed radially between the yoke and the roll jacket, the pressure chamber extending around the first roll over a portion thereof so that the direction of action of the pressure chamber lies in the resultant of the pressing forces of the second and third press rolls toward the first press roll.

* * * * *